United States Patent [19]

Haws

[11] 4,406,548

[45] Sep. 27, 1983

[54] MOBILE CONCRETE MIXING APPARATUS

[76] Inventor: Paul M. Haws, 3144 S. 57th W. Ave., Tulsa, Okla. 74107

[21] Appl. No.: 364,199

[22] Filed: Apr. 2, 1982

[51] Int. Cl.[3] ..... B28C 5/34; B28C 7/06; B28C 7/12

[52] U.S. Cl. ..... 366/8; 366/34; 366/37; 366/64

[58] Field of Search ..... 366/27, 30, 31, 34, 366/33, 37, 40, 50, 64, 155, 156, 319, 322, 2, 6, 8, 3; 222/197

[56] References Cited

U.S. PATENT DOCUMENTS

| | | | |
|---|---|---|---|
| 216,958 | 7/1879 | Hudson | 366/322 X |
| 796,591 | 8/1905 | Martin | 366/37 |
| 1,900,458 | 3/1933 | Morrow | 222/197 |
| 3,336,011 | 8/1967 | Futty | 366/222 |
| 3,339,898 | 9/1967 | Futty et al. | 366/6 |
| 3,456,925 | 7/1969 | Gallagher | 366/27 |
| 3,469,824 | 9/1969 | Futty et al. | 366/64 |
| 4,071,226 | 1/1978 | Miller | 366/64 |

*Primary Examiner*—Philip R. Coe

*Assistant Examiner*—Thomas W. Epting

*Attorney, Agent, or Firm*—Head, Johnson & Stevenson

[57] ABSTRACT

A mobile concrete mixing apparatus comprising an aggregate storage bin and cement storage bin mounted on a mobile carrier in spaced relation, a water supply tank mounted on the carrier and in operable communication with a water discharge pipe disposed in the proximity of the cement storage bin, a conveyor apparatus movable beneath and between the aggregate storage bin and cement storage bin for moving materials therefrom for discharge into a mixing auger assembly, the aggregate storage bin containing premixed sand and rock materials for achieving a homogeneous moisture and temperature therebetween, the sand-rock mixture, cement mixture and water being mixed together prior to admission thereof into the mixing auger assembly, the auger assembly comprising a plurality of material moving stages and a plurality of mixing stages interposed therebetween to assure a homogeneous mixture for delivery from the mixing auger assembly, all of the operation of the concrete mixing apparatus being initiated by a single lever operation.

1 Claim, 12 Drawing Figures

MOBILE CONCRETE MIXING APPARATUS

BACKGROUND OF THE INVENTION

1. Field of the Invention

This invention relates to improvements in concrete mixing apparatus and more particularly, but not by way of limitation, to a mobile concrete mixing apparatus.

2. Description of the Prior Art

There are many devices presently available for transporting and mixing the ingredients of concrete, such as those shown in the Robert C. Futty Pat. No. 3,623,708, issued Nov. 30, 1971, and entitled "System and Means for Selectively Mixing Concrete and Incorporating Dry Additives Therein," and the H. M. Zimmerman Pat. No. 3,310,293, issued Mar. 21, 1967, and entitled "Concrete Mixing and Delivery System." In the presently available devices of this type, the several ingredients of the concrete are deposited within a mixing device separately or individually and subsequently mixed together, along with water, to achieve the end product. For example, the rock materials and sand materials are deposited in side-by side relation on a carrier, such as a conveyor belt, and cement is dropped onto the carried above the rock and sand materials, and the materials are directed into the auger mixer without a premixing thereof. In addition, water is added to the auger mixer independently of the aggregates (rock and sand) and cement. By and large, the concrete resulting from these present day devices is not of the quality which is frequently required for this type material.

SUMMARY OF THE INVENTION

The present invention contemplates a novel mobile concrete mixing apparatus which has been particularly designed and constructed for overcoming the foregoing disadvantages. A considerable amount of research has been conducted in order to develop a method and means for mixing concrete in a manner whereby the end product achieved in a mobile unit is of an improved excellence of quality. It has been noted that the rock materials normally used in a concrete formula are substantially always drier and of a greater temperature than the sand materials used therein. This temperature difference is present regardless of whether or not the ambient temperature is high or low. As a result, when the water is added to the sandrock mixture, the rock materials frequently absorb a greater quantity of the water, leaving the sand materials in a low moisture content state. This apparently has a great adverse effect on the end quality of the concrete produced.

In order to overcome this problem, the present invention provides an apparatus wherein the rock and sand are premixed prior to placing thereof in the ultimate mixing apparatus. This premixing increases the moisture content of the rock material and creates a substantially homogeneous temperature between the rock materials and sand. Thus, when the cement and water are added to the premixed sand and rock, the overall homogeneous nature of the end product is excellent, and a high quality concrete is produced. Furthermore, the premixed rock and sand materials are introduced into the mixing area simultaneously with the cement and water in that the cement and water are added to the premixed sand and rock materials prior to the introduction of all of the ingredients into the mixing area.

The premixed rock, sand, cement and water are directed into a first stage simultaneously or all at once, the first stage being a conveying section which force moves the ingredients into a second stage wherein the mixture is initially agitated or stirred for a further mixing thereof. The first stage conveying area constantly moves the incoming ingredients toward the second stage for forcing the previously encountered material to move the partially mixed materials from the second stage to a third stage, which is a conveying stage. This second conveying stage force moves the partially mixed materials into a final mixing stage (stage four), where the mixture is agitated to provide a substantially homogeneous mixture. From the final mixing stage, the mixture is passed or force moved into a final moving stage for delivery to the use site for the concrete mixture. It is particularly to be noted that the mixture in the agitation or mixing stages is not moved in a forward direction or reverse direction but is merely stirred or mixed until the mixture is forced from the mixing stage by the material being forced from the conveying stages.

One of the important features of the premixing of the present invention is that a consistency of end product is provided since a positive control is possible for each of the ingredients being added together in accordance with the particular concrete formula. In addition, it is well known that cement clings to the walls of any chamber or feed wheel utilized in connection therewith due to the static electricity conditions of the material. This is a hinderance in the preparation of concrete and in order to overcome this disadvantage, a steel ball, or the like, is loosely disposed within the interior of the feed wheel, and as the feed wheel rotates for discharging the cement material from the cement hopper or container, the ball knocks against internally disposed flanges or bracket members to impart a shock to the feed wheel, thus loosening any cement which may be clinging to the inner periphery thereof. This feature has been found to provide an efficient discharge of the cement from the feed wheel as well as facilitating the cleaning of the interior of the feed wheel since substantially all of the cement will be discharged therefrom.

A further assistance for the delivery of the cement from the cement hopper is the structural design of the cement hopper itself. The lower portion of the hopper is provided with inwardly directed sidewalls forming a natural chute through which the cement is discharged, and this configuration in combination with the action of the loose disposed ball in the feed wheel provides an extremely efficient discharge action for the cement. Of course, the premixing of the sand and rock prior to addition of the cement and water thereto substantially precludes a preset of the concrete since the premixing of the sand and rock distributes the natural moisture and temperature of the two materials evenly therebetween to avoid the excessive absorption of the water by the rock material during the mixing of the rock, sand, cement and water to produce the end product.

The mobile apparatus for mixing the concrete is of a simple design and construction for ease of maintenance. All of the products utilized in the construction of the machine or apparatus are standard "of the shelf" items, which may be readily obtained in substantially any area having sufficient population to support a "parts" store, or the like. The apparatus is preferably mounted on a wheeled vehicle, but may be skid mounted, or the like, if desired, and is provided with a single action control which stops and starts the operation of the mixing apparatus, and the overall simplicity of operation greatly reduces or substantially eliminates the need for a prolonged training period or program for operators of the apparatus. The novel machine or apparatus is simple and efficient in operation and economical and durable in construction.

DETAILED DESCRIPTION OF THE PREFERRED EMBODIMENT

Figure 10:
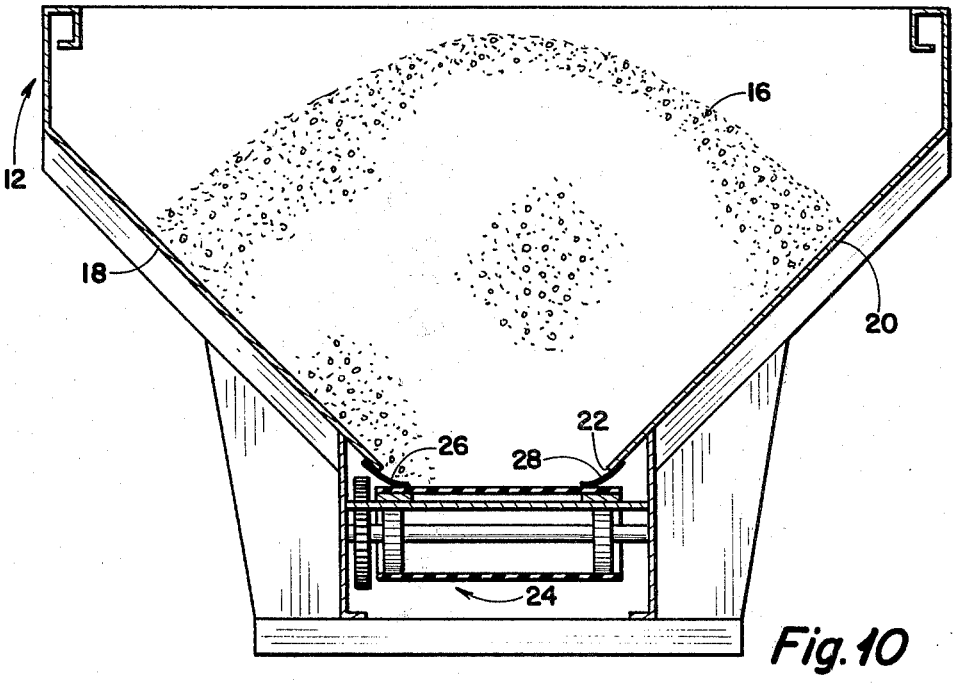
FIG. 10 is a view taken on line 10—10 of FIG. 2.
Figure 11:
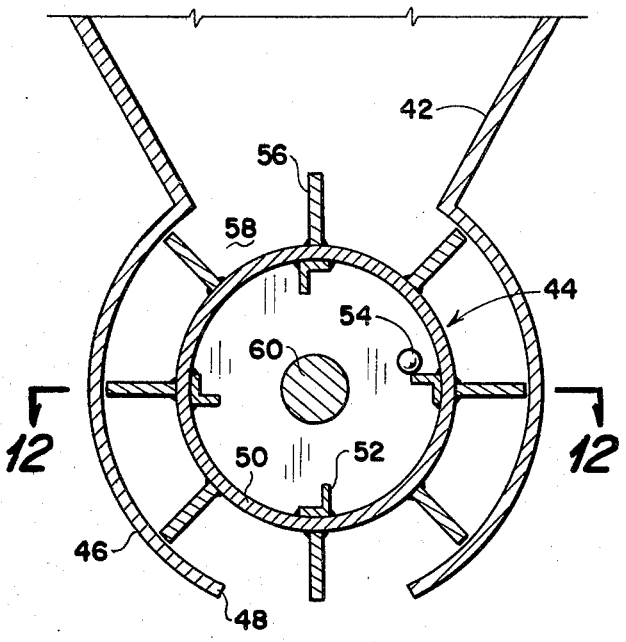
FIG. 11 is a view taken on line 11—11 of FIG. 9.
Figure 12:
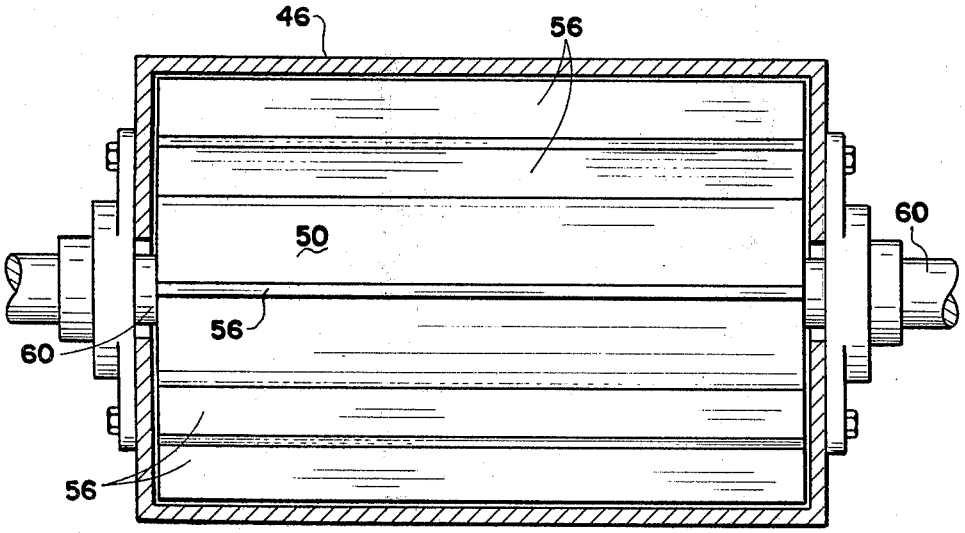
FIG. 12 is a view taken on line 12—12 of FIG. 11.

Referring to the drawings in detail, reference character 10 generally indicates a mobile concrete mixing apparatus embodying the invention and comprising an aggregate storage bin 12 mounted on a suitable mobile carrier, such as a wheeled vehicle 14, skid (not shown), or the like, for receiving and storing a selected quantity of sand and gravel or rock 16 (FIGS. 8 and 10) therein. The sand and rock 14 is premixed in particularly selected ratios in accordance with the formula for the concrete end product to be manufactured in the unit or apparatus 10, as will be hereinafter set forth.

The bin 12 is provided with oppositely disposed inwardly directed sidewalls 18 and 20 in the lower portion thereof to provide a discharge opening 22 (FIG. 10) therebetween. The discharge opening 22 is spaced slightly above the upper run of a suitable conveyor belt apparatus 24 whereby the sand-rock mixture 14 may be deposited directly thereon. In addition, a pair of substantially identical oppositely disposed flexible guard members 26 and 28 are suitably secured to the side edges of the opening 22 and extend throughout the length thereof to facilitate the discharge of the sand-rock mixture 14 onto the upper run of the conveyor apparatus 24 during a concrete mixing or manufacturing operation. Furthermore, a suitable metering gate 30 (FIG. 8) is secured to one end 32 of the bin 12, and extends across an opening 34 provided in the end 32 in the proximity of the upper run of the conveyor apparatus 24. The sand-rock mixture 14 deposited on the conveyor apparatus 24 through the opening 22 is carried through the opening 34 for a purpose and in a manner as will be hereinafter set forth. The metering gate 30 wipes the upper surface of the mixture emerging through the opening 34 for metering the quantity of the mixture delivered from the bin 12.

A concrete storage and delivery bin 36 is suitably mounted on the mobile carrier 14 in spaced relation with respect to the aggregate bin 12, and is in communication with the upper run of the conveyor apparatus 24 for depositing cement on the upper surface of the sand-rock mixture 14 emerging from the bin 12 as will be hereinafter set forth. The concrete bin 36 is preferably supported on the carrier 14 by a suitable frame structure 38 and is preferably of a substantially square cross sectional configuration, but not limited thereto. The four walls of the lower portion of the bin 36 are directed angularly inwardly as shown at 40 to provide a chute-like passageway 42 for discharging cement therefrom. A rotatable feed wheel 44 is journalled below the passageway 42 and receives the cement therefrom, as will be hereinafter set forth. The feed wheel 44 is mounted in a suitable housing 46 having a discharge opening 48 at the lower end thereof open to the upper run of the conveyor apparatus 24. The feed wheel 44 preferably comprises a central cylindrical housing 50 having a plurality of circumferentially spaced inwardly directed flanges 52 secured to the inner periphery thereof and rotatable simultaneously therewith. A steel ball 54, or the like, is loosely disposed within the housing 50 and knocks against or engages the flanges 52 during rotation of the feed wheel 44. A plurality of circumferentially spaced baffles 56 are provided around the outer periphery of the housing 50 to provide a compartment 58 between each successive pair of baffles 56. The feed wheel 44 is suitably secured to a shaft 60 in any well known manner for rotation thereby during discharge of the cement onto the conveyor apparatus 24 during a concrete mixing or manufacturing operation. As is well known, cement tends to cling to the surfaces of any container or feed apparatus therefor, and the engagement of the ball 54 with the flanges 52 provides a jarring of the housing 46 and baffles 56 to substantially preclude the adhering of the cement thereto.

A water storage tank 62 is mounted on the mobile carrier 14 in any suitable manner and as shown herein is preferably mounted against the end of the aggregate bin 12 oppositely disposed with respect to the end 32. A water discharge pipe 64 (FIG. 8) is mounted in spaced relation with respect to the cement bin 36 and beyond the outer limit of the conveyor apparatus 24. Of course, a suitable housing 66 surrounds the portion of the conveyor apparatus extending beyond the bin 12 and encases the water discharge pipe 64 for purposes of convenience. The water discharge pipe 64 is in communication with the water tank 62 through suitable conduit means 68, and suitable pumping means 70 is interposed in the conduit means 68 for pumping the water from the reservoir or tank 62 to the discharge pipe 64 when required. The water discharge pipe 64 is provided with a plurality of spaced ports 72 for "jetting" the water into the interior of the housing 66 in the proximity of the outer end of the conveyor apparatus 24, for a purpose and in a manner as will be hereinafter set forth in detail.

Figure 4:
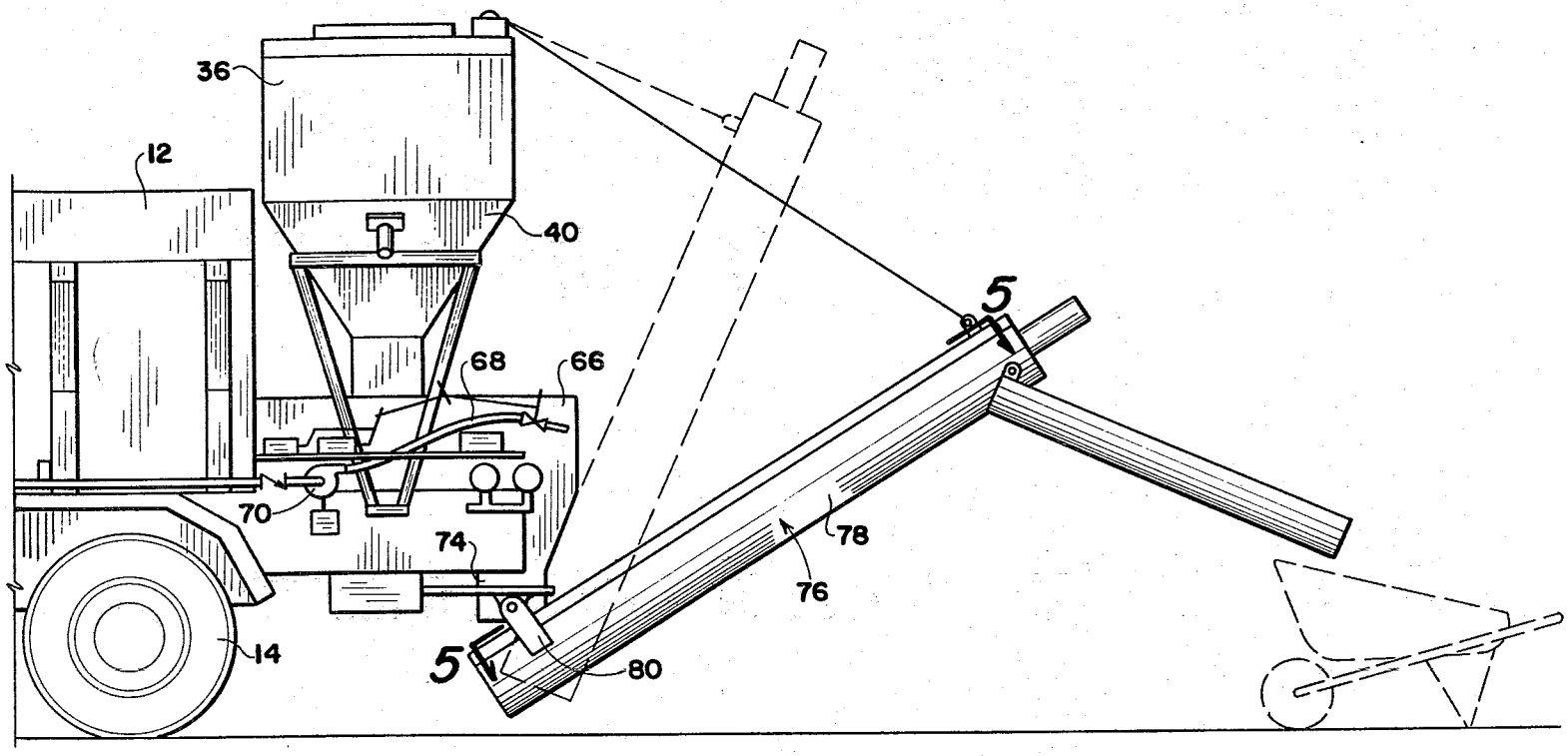
FIG. 4 is a left side elevational view of the rear portion of a mobile concrete mixing apparatus embodying the invention, particularly illustrating the auger and delivery chute means, with one position thereof shown in solid lines and another position thereof shown in broken lines for purposes of illustration.

The housing 66 is provided with a downspout or discharge port 74 which is in open communication with the interior of a mixing auger assembly generally indicated at 76. (The mixing auger 76 is omitted in FIGS. 1 and 2 for purposes of illustration.) The auger assembly 76 comprises an elongated chute member 78 having the upper end thereof, as viewed in the drawings, open for receiving materials therein, as will be hereinafter set forth, and the chute 78 is pivotally secured to the mobile carrier 14 in any suitable manner, as shown at 80 in FIG. 4, for pivotal movement between a concrete mixing and delivery position shown in solid lines in FIG. 4, and a stowage or transporting position as shown in broken lines therein. A suitable hoisting cable arrangement 79 is operably secured between the concrete bin 36 and the chute 78 for facilitating the raising and lowering thereof.

Figure 5:
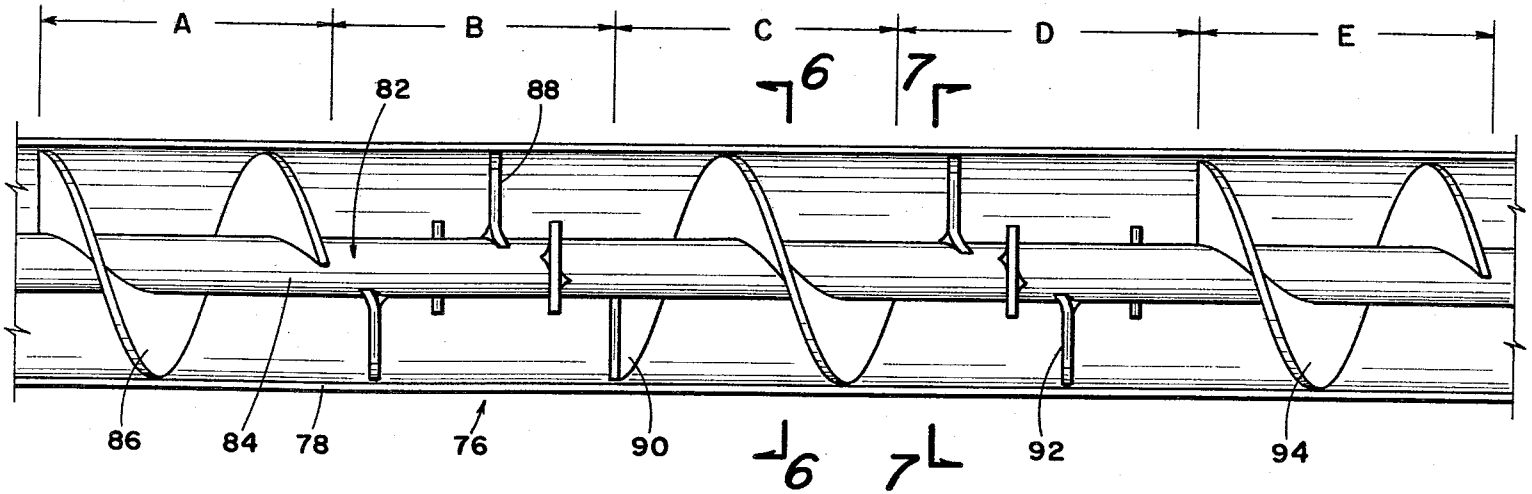
FIG. 5 is a view taken on line 5—5 of FIG. 4.
Figure 7:
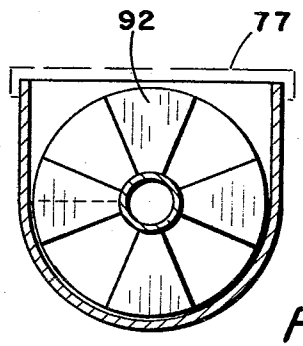
FIG. 7 is a view taken on line 7—7 of FIG. 5.
Figure 6:
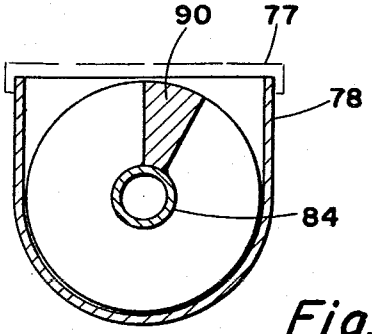
FIG. 6 is a view taken on line 6—6 of FIG. 5.

Referring now to FIGS. 5, 6 and 7, the auger assembly 76 is provided with a centrally disposed elongated mixing apparatus generally indicated at 82 which provides a plurality of operational stages within the auger apparatus or assembly 76. The apparatus 82 is rotatable within the chute 78 and comprises a central shaft 84 rotatable about its own longitudinal axis. An outwardly extending helical flange 86 is secured to the outer periphery of the shaft 84 and extends longitudinally therealong throughout a preselected distance to provide a first stage A for the auger assembly 76. Stage A is a material moving section as well as a material receiving section. A plurality of radially outwardly extending baffles 88 are secured to the outer periphery of the shaft 84 and are circumferentially and longitudinally spaced therealong throughout a selected distance beyond the flange 86 to provide a second stage B for the auger assembly 76. A second helical flange 90 is secured to the outer periphery of the shaft 86 and extends outwardly therefrom throughout a selected longitudinal distance beyond stage B to provide a third stage C for the auger assembly 76. Whereas stage B is a mixing stage or section only, and odes not move the material contained therein in a longitudinally direction, the third stage C is a moving or conveying stage and cooperates with stage A for moving material longitudinally through the chute 78. A second plurality of radially outwardly extending baffles 92 are secured to the outer periphery of the shaft 84 is circumferential and longitudinally spaced relation and extend along the length of the shaft 84 a selected distance beyond stage C to provide a fourth stage D for the auger assembly 76. Stage D is a mixing stage only, similar to stage B, and provides the final mixing for the material contained therein, as will be hereinafter set forth. Still another outwardly extending helical baffle or flange 94 is secured to the outer periphery of the shaft 84 and extends longitudinally therealong beyond stage D to provide a fifth stage E, which is a final conveying stage for delivery of the material through the outer end of the chute 78 and discharges the material into a suitable trough 96, or the like, which, in turn, delivers the material to a suitable conveyor, such as a wheel barrel 98, or directly into the area wherein the material from the apparatus 10 is to be utilized.

Figure 1:
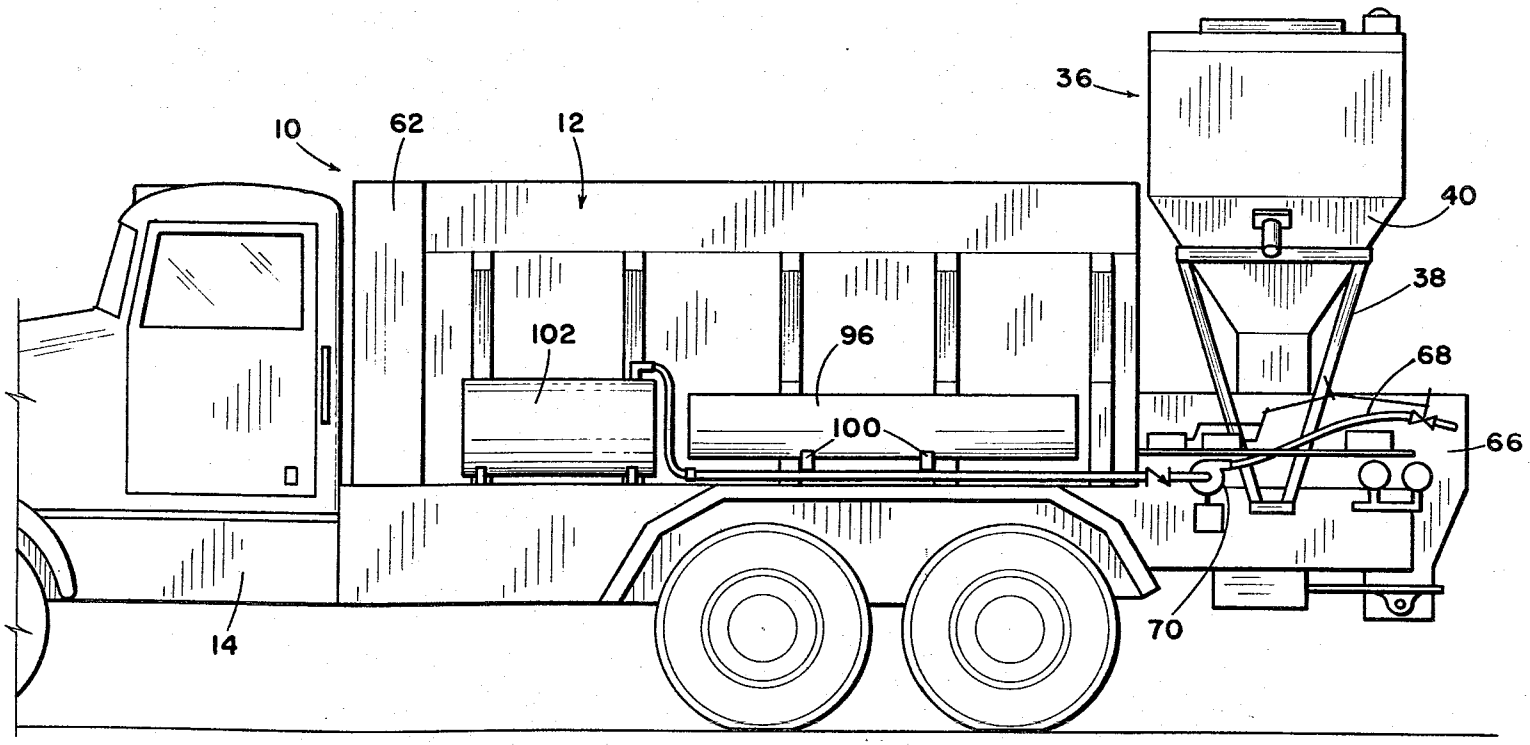
FIG. 1 is a left side elevational view of a mobile concrete mixing apparatus embodying the invention, with a portion of the cab of the vehicle upon which the apparatus is mounted omitted for purposes of illustration.
Figure 2:
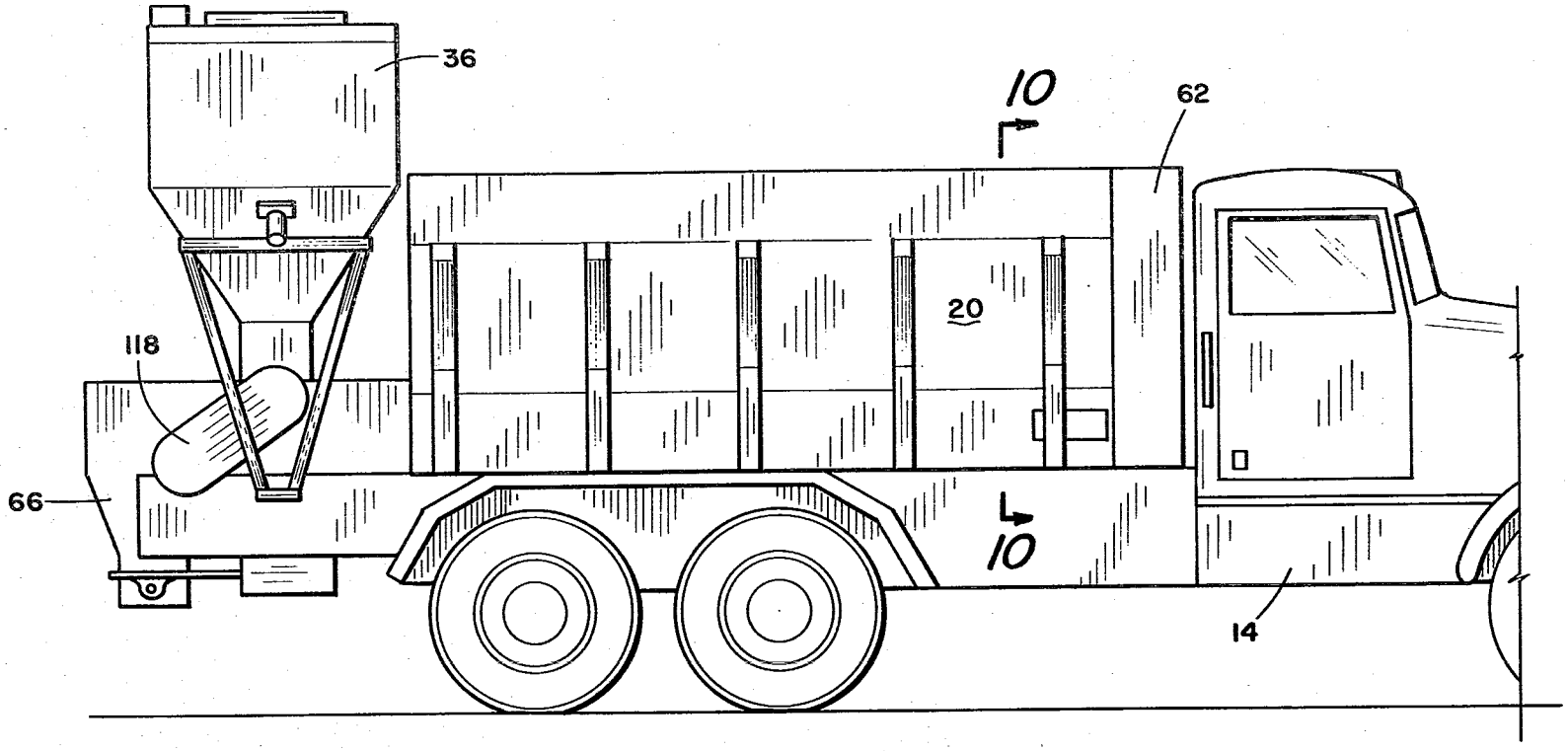
FIG. 2 is a right side elevational view of a mobile concrete mixing apparatus embodying the invention, with a portion of the vehicle cab omitted as in FIG. 1.

The trough or chute 96 may be of any suitable construction, and is preferably independent of the auger apparatus 76 in order that it may be transported on the mobile carrier 14 as particularly shown in FIG. 1. A suitable support or cradle structure 100 may be provided on the carrier 14 for supporting the trough 96 during transporting of the apparatus 10. In addition, a suitable hydraulic fluid tank or reservoir 102 may be mounted on the carrier 14 in any suitable manner for storage of a suitable hydraulic fluid for actuation or operation of the apparatus 10. Of course, suitable hydraulic lines or conduits (not shown) are provided between the reservoir 102 and operational components for the apparatus 10 as will be hereinafter more fully set forth.

Figure 9:
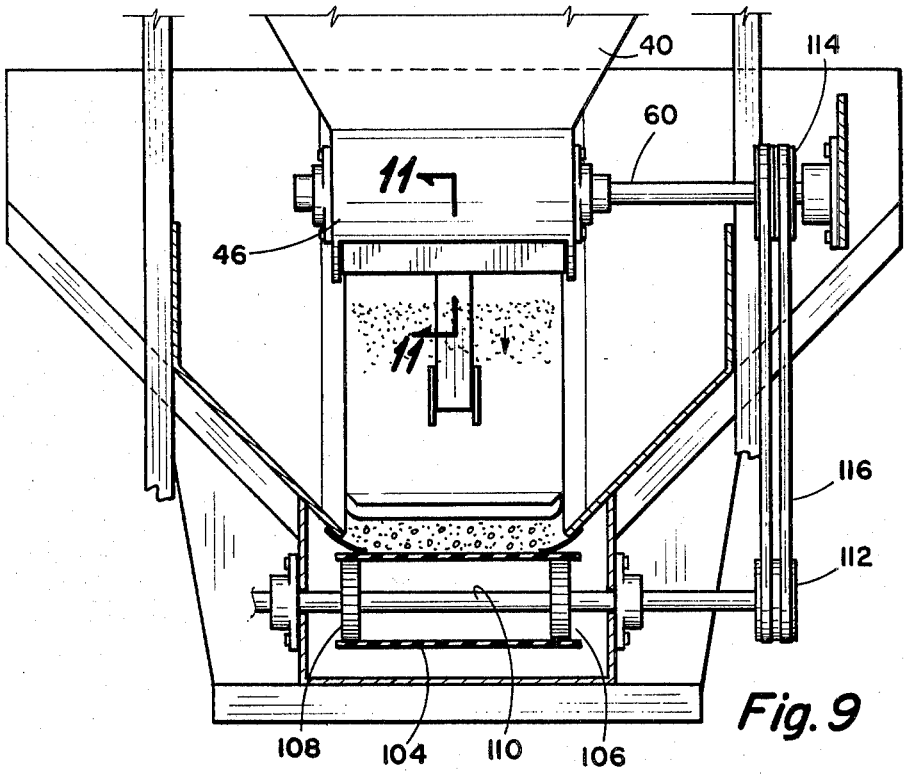
FIG. 9 is a view taken on line 9—9 of FIG. 8.

The conveyor apparatus 24 comprises the usual endless belt means 104 which may be driven in any suitable manner for a continuous longitudinal movement during operation of the apparatus 10, as for example by a pair of spaced drive wheels 106 and 108 mounted on a powered drive shaft 110. Of course, additional support wheels, or the like, not shown, are longitudinally spaced throughout the length of the conveyor belt 104, as is well known. The shaft 110 extends beyond the conveyor apparatus 24 for driving a suitable pulley means 112 (FIG. 9) which is operation connected with a complementary pulley means 114 through belt drive means 116. The pulley means 114 is secured to the shaft 60 for rotation thereof in synchronization with respect to the rotation of the drive wheels 106 and 108 to provide for synchronous movement between the belt means 104 and the feed wheel means 44. Or course, suitable cover means 118 is secured to the housing for protection of the pulleys 112 and 114 and belt means 116, as is well known.

Figure 8:
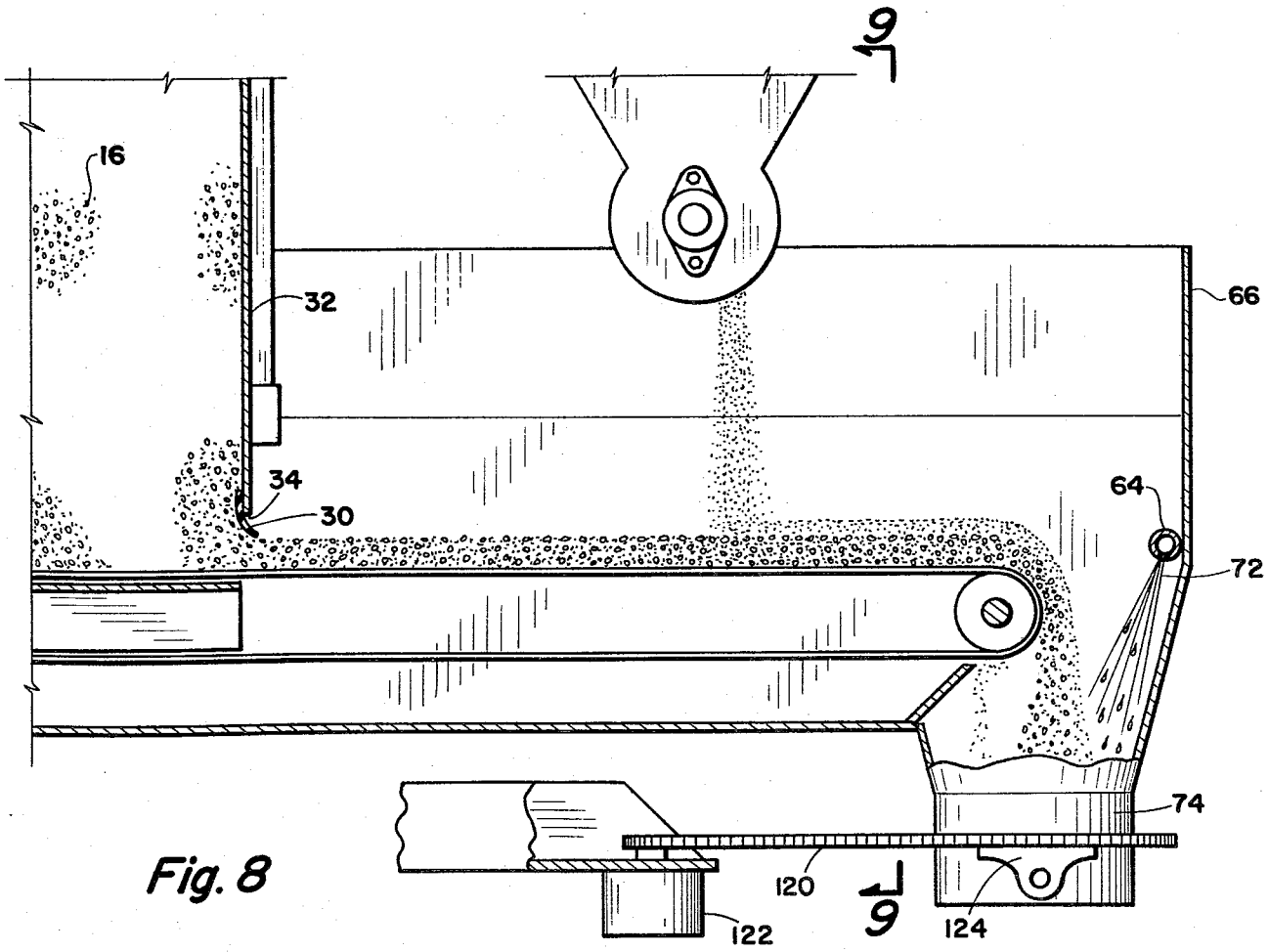
FIG. 8 is a sectional view of a portion of the materials conveyor apparatus illustrating the sequence of operation for mixing the concrete materials prior to discharging thereof into the auger.

The auger assembly 76 is not only pivotally secured to the carrier 14 as 80 for movement in a vertical direction, but is also secured for rotation in a substantially horizontal plane in order to position the discharge outer end of the chute 78 in the desired location for delivery of the materials from the auger assembly. A gear member (not shown) is secured to the outer periphery of the discharge chute 74 of the housing 66 and is rotatable about its own central axis. A second gear member (not shown) is disposed in spaced relation with respect to the first gear and is operably connected therewith by a suitable drive chain member 120 (FIG. 8). The second gear is driven by a suitable motor 122 which is secured to the carrier 14 in any suitable manner. The first gear is connected with the chute 78 of the auger assembly 76 by means of a pair of diametrically spaced flanges 124 (only one of which is shown in FIG. 8, the flanges 124 being connected to the chute 78 at 80. As the chain 120 rotates the gear secured to the discharge chute 74, the auger assembly 76 may be rotated in a substantially horizontal plane.

Figure 3:
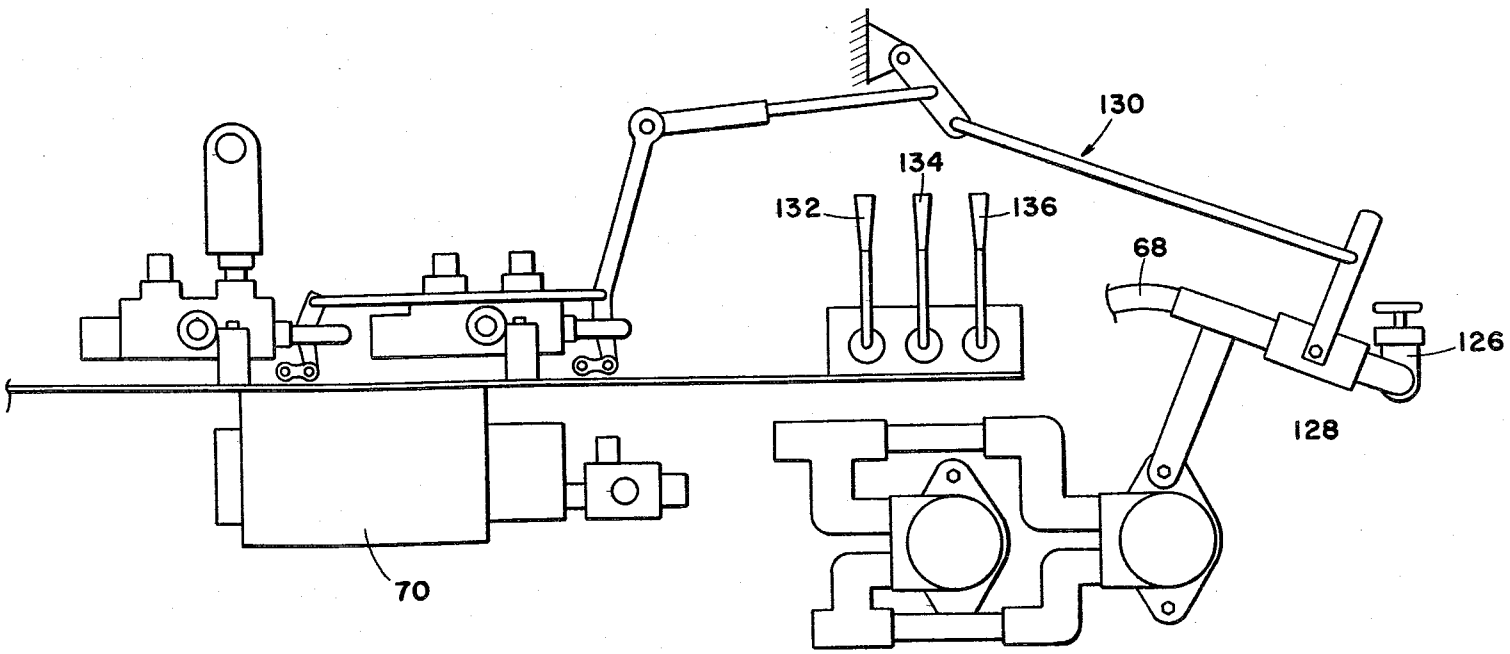
FIG. 3 is a side elevational view of the control panel or control area of a mobile concrete mixing apparatus embodying the invention.

Referring now to FIG. 3, the supply of water from the reservoir or tank 62 through the conduit means 68 and to the water discharge pipe 64 may be controlled by a suitable adjustment valve means 126. The valve 126 may be "set" or adjusted in any well known manner for controlling the quantity of water to be delivered through the conduit means 68 to the water discharge pipe 64. In addition, a suitable on-off valve means 128 is interposed in the conduit means 68 between the adjusting valve means 126 and the reservoir or tank 62, and is actuated by a suitable lever mechanism, generally indicated at 130. The valve means 128 may be shut or closed in order to permit the adjusting valve means 126 to be properly positioned, whereupon the valve 128 may be opened to direct the selected water supply to the water delivery pipe 64. The lever mechanism 130 is also operably connected with the auger drive mechanism and operably connected with the conveyor drive mechanism and cement drive wheel mechanism whereby the entire apparatus 10 may be activated through a single lever operation. A suitable lever actuator 132 is provided and operably connected with the water pump 70 for actuation thereof when desired. A similar lever actuator 134 is operably connected with the winch means for raising and lowering of the auger assembly 76, and another lever actuator 136 is provided in operable connection with the drive means for providing the proper horizontal orientation of the auger assembly 76.

In operation, the conveyor apparatus 24 is activated simultaneously with the activation of the cement feed wheel means 44, and the auger assembly 76 is positioned as required for delivery of the materials therefrom at the desired location, such as into the wheel barrel 98, or the like. The supply of water is also initiated to the water discharge pipe 64. The premixed sand-rock material within the aggregate bin 12 is deposited on the upper run of the belt means 104 and moves longitudinally therewith in the direction toward the cement bin 36. As the pemixed sand-rock mixture moves through the opening 34, the metering gage means 30 wipes the upper surface of the mixture for maintaining a selected quantity of the mixture moving along the conveyor belt and beneath the cement feed wheel means 44. The cement from the feed wheel means drops the cement onto the rock-sand mixture passing thereunder, as shown in FIG. 8, and the cement, sand-rock mixture is carried to the outer end of the belt means 104 for release into the discharge chute 74. At the same time, the water supply is directed to the water discharge pipe 64 whereby the water is sprayed into the cement-sand-rock mixture leaving the outer end of the belt means 104. Thus, the cement-sand-rock mixture is wetted or mixed with water prior to entering stage A of the auger assembly 76. It is to be noted that it is preferable to provide a cover member 77 (shown in broken lines in FIGS. 6 and 7) over a portion of the open upper end of the chute 78 to cover stages B, C, D and E.

The premixed cement, sand-rock and water mixture is admitted into stage A, where the flange 86 forces the mixture into the first mixing stage B. Of course, as the material continues to drop into stage A, the material previously admitted thereto is forced into the initial mixing stage B by the action of the flange 86 moving all of the material therein longitudinally through the chute 78. The baffles 88 agitate and mix the material in stage B, but the only force moving the material out of stage B is the incoming material forced therein from stage A. The material leaving stage B enters the second conveying stage C where it is force moved into the final mixing stage D. The baffles 92 perform a final mixing of the material in stage D, and the material in stage D is force moved by the material entering from stage D. The homogeneous mixture in stage D enters the final conveying or moving stage E for discharge from the outer end of the auger assembly 76 into the delivery chute 96.

As hereinbefore set forth, the premixing of the sand and rock substantially precludes any presetting of the concrete, thus assuring that the ultimate concrete material will be of an excellent quality. In addition, the premixing of the cement and water with the premixed sand the rock further assures the excellent quality of the end product.

Whereas the present invention has been described in particular relation to the drawings attached hereto, it should be understood that other and further modifications, apart from those shown or suggested herein may be made within the spirit and scope of this invention.

What is claimed is:

1. A method of producing concrete comprising the steps of initially premixing a quantity of sand and rock to provide a substantially homogeneous moisture content and temperature for the mixture, delivering a preselected quantity of the sand and rock mixture to a source of dry cement, discharging a preselected quantity of the dry cement onto the sand and rock mixture in accordance with a selected ratio therebetween, applying water to the cement and sand and rock mixture for a prewetting thereof, subsequently directing the prewetted cement and sand and rock mixture into a receiving chamber, moving the mixture from the receiving chamber into a first mixing chamber, forcing the mixture from the first mixture chamber into a conveying chamber by the movement of subsequent quantities of the mixture, forcing the mixture into at least one more mixing chamber by the movement of said subsequent quantities of the mixture, and discharging the mixture for its intended use.

* * * * *